United States Patent [19]

Binder

[11] Patent Number: 4,673,155

[45] Date of Patent: Jun. 16, 1987

[54] VERTICALLY ADJUSTABLE BOAT FURNITURE

[76] Inventor: William T. Binder, 7757 Clayton Rd., St. Louis, Mo. 63117

[21] Appl. No.: 853,632

[22] Filed: Apr. 18, 1986

[51] Int. Cl.[4] ..... F16M 11/00

[52] U.S. Cl. ..... 248/404; 108/147; 248/188.5; 248/407; 297/347; 297/DIG. 3

[58] Field of Search ..... 248/161, 407, 162.1, 248/188.5, 669, 125, 404, 157, 544, 27.1, 677; 297/DIG. 3, 347, 339, 330; 108/147

[56] References Cited

U.S. PATENT DOCUMENTS

| | | | |
|---|---|---|---|
| 228,518 | 6/1880 | Dawes | 248/407 X |
| 3,069,124 | 12/1962 | Roberts | 248/404 |
| 3,188,136 | 6/1965 | Redfield et al. | 248/404 X |
| 3,436,048 | 4/1969 | Greer | 248/404 X |
| 3,642,320 | 2/1972 | Ward | 248/407 X |
| 3,967,458 | 7/1976 | Scales | 254/105 X |
| 4,032,725 | 6/1977 | McGee | 248/27.1 X |
| 4,234,989 | 11/1980 | Pearcy | 248/404 X |
| 4,274,330 | 6/1981 | Witten et al. | 248/27.1 X |
| 4,513,937 | 4/1985 | Langmesser, Jr. et al. | 248/423 X |

FOREIGN PATENT DOCUMENTS

| | | | |
|---|---|---|---|
| 2108466 | 5/1983 | United Kingdom | 297/347 |

*Primary Examiner*—Ramon S. Britts
*Assistant Examiner*—David L. Talbott
*Attorney, Agent, or Firm*—Polster, Polster & Lucchesi

[57] ABSTRACT

A piece of boat furniture is vertically adjustable by a pneumatically controlled system. The furniture includes a base securely mountable to the deck of a boat. A first hollow shaft of generally square cross section is secured to the base and extends upwardly therefrom. A second hollow shaft of generally square cross section is longitudinally movable with respect to the first shaft. The shafts are coaxial, with one of the shafts disposed at least partially inside the other. The spacing between the shafts is sufficiently small that the shafts cannot twist or rotate with respect to each other. A fluid operated piston is operably secured to the second shaft for moving it longitudinally with respect to the first shaft. A mounting surface is disposed at the top of the second shaft and fixedly secured thereto. A seat, table top or the like is secured to the mounting surface. A pneumatic system which is manually operable is provided for by operating the piston to move the mounting surface to a desired height, whereby the seat, table top or the like is readily position at a desired height with respect to the deck of a boat.

6 Claims, 8 Drawing Figures

11
13
15
17
19
21
23
25
27
29
31
33
35
37
39
41
43
45
47
49
51
53
55
57
4

VERTICALLY ADJUSTABLE BOAT FURNITURE

BACKGROUND OF THE INVENTION

This invention relates generally to furniture for pleasure boats and more particularly to such furniture which is vertically adjustable.

From time to time it is desirable to raise or lower various items of boat furniture such as boat seats or boat tables. For example, the operator's seat should be in an elevated position during take-off because of the tendency of the bow to rise during acceleration, which would otherwise cut off the operator's vision. Once the acceleration ceases or by artificial trim, the bow lowers back into the water, and the operator's chair could then be lowered. Other examples of the desirability of having such adjustable boat furniture include the seats used on fishing boats which are desirably elevated during fishing and lowered during movement of the boat. Of course, it could also be desirable to have other pieces of furniture such as tables or boating equipment such as a fish locator which can be raised to a desired height when needed and lowered out of the way when not in use.

U.S. Pat. No. 3,642,320 to Ward shows a vertically adjustable boat seat for fishing boats and the like. This particular seat is manually adjustable and includes a number of preset positions for the seat. (See FIG. 3). This particular adjustable boat seat includes a round cylindrical telescoping shaft by means of which the height adjustment is made. It is believed that such round telescoping shafts, while suitable for fishing boats, may not be desirable for power boats because of the higher torques involved which could result in twisting of the seat with respect to the base on which it is mounted. U.S. Pat. No. 3,848,921 to Rhodes shows a similar boat seat with a lever 16 which is presumably used to adjust the level of the seat. Although this patent shows a generally square pedestal, it does not disclose any internal construction which would keep the seat itself from swiveling with respect to the base.

U.S. Pat. No. 4,008,500 to Hall discloses an adjustable fishing boat platform which includes a round pedestal or tube which is secured within a mounting base by means of bolts. This particular construction would also appear to be sensitive to the twisting torques mentioned above if used on a power boat. U.S. Pat. No. 4,234,989 to Pearcy shows a pneumatically adjustable pedestal for a boat seat. The pedestal is round in cross section and the lowest portion of the pedestal extends down below the level of the deck. (See FIG. 2) This use of pneumatics to adjust the level of the seat (which apparently is to be used by a fisherman rather than the boat operator) is an advantage, but this particular construction is still believed to be subject to twisting of the boat seat with respect to the base upon the application of torque such as would result from a rapid take-off in a power boat.

Once an operator's seat is elevated during take-off of the boat, there is a substantial force tending to pull the base of the chair out of the deck to which it is mounted. As the operator is forced to the rear of the seat upon take-off, the front of the base is subjected to a considerable force and torque tending to tear the chair base out of the deck. Prior mounting systems are not believed to adequately address this situation in a way which both securely holds the chair in place during take-off and yet is easy to install.

SUMMARY OF THE INVENTION

Among the various objects and features of the present invention may be noted the provision of a vertically adjustable piece of boat furniture which is more resistant to twisting caused by the acceleration of the boat on which it is mounted.

Another object of the present invention is the provision of such a piece of boat furniture which is securely and easily mountable to a boat deck.

Another object of the present invention is the provision of such a piece of boat furniture which is easily and readily adjustable to a desired height.

Another object of the present invention is the provision of such a piece of boat furniture which provides improved operator visibility during acceleration of a boat.

Other objects and features will be in part apparent and in part pointed out hereinafter.

Briefly, vertically adjustable boat furniture of the present invention includes a base securely mountable to the deck of a boat, a first hollow shaft of generally square cross section secured to the base and extending upwardly therefrom, and a second hollow shaft of generally square cross section longitudinally movable with respect to the first shaft. The shafts are coaxial, one of the shafts being disposed at least partially inside the other. The spacing between the shafts is sufficiently small that the shafts cannot rotate with respect to each other. A fluid operated piston is operably secured to the second shaft for moving it longitudinally with respect to the first shaft. A mounting surface is disposed at the top of the second shaft and fixedly secured thereto. A seat, table top, or the like is secured to the mounting surface. Manually operable pneumatic controls are provided for operating the piston to move the mounting surface to a desired height, whereby the seat, table top, or the like is readily positioned at a desired height with respect to the deck of the boat.

BRIEF DESCRIPTION OF THE DRAWINGS

Similar reference characters indicate similar parts throughout the several views of the drawings.

DESCRIPTION OF THE PREFERRED EMBODIMENT

Figures 1, 2:
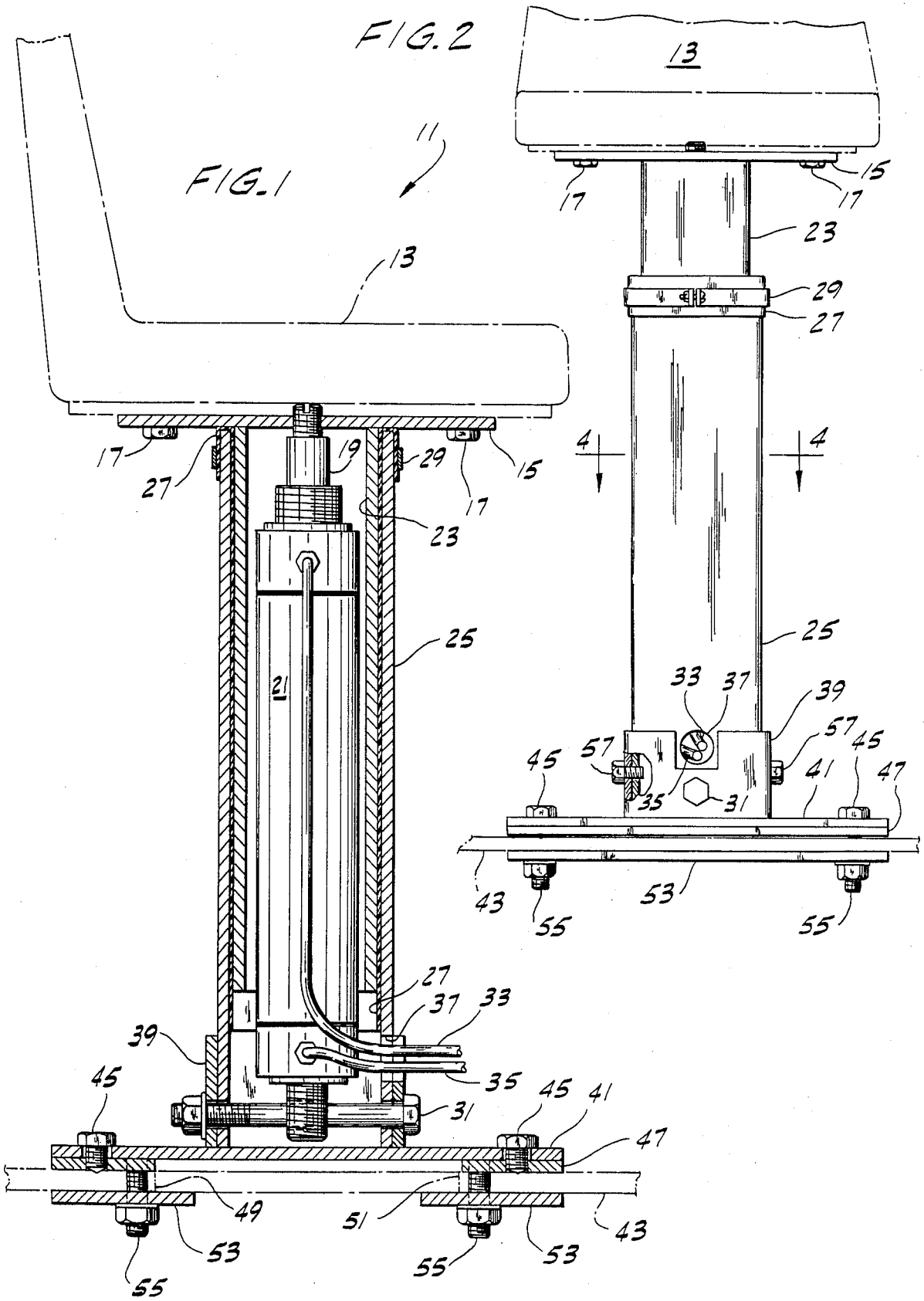
FIG. 1 is a side elevation, with parts broken away for clarity, of an adjustable piece of ooat furniture of the present invention.
FIG. 2 is a front elevation of the piece of boat furniture of FIG. 1.

A vertically adjustable boat seat 11 of the present invention includes a standard seat portion 13 suitably secured to a steel mounting plate or surface 15 by a plurality of threaded fasteners 17. Mounting plate 15 is eight inches square and 1/4 inch thick, although a number of other shapes and sizes could be used depending upon the particular seat which is mounted thereon and the particular boat or vessel in which it is mounted. The mounting surface 15 has a central threaded bore by means of which it is secured to the piston 19 of a two-way, three inch pneumatic cylinder 21. Mounting surface 15 rides on and is welded to an inner shaft 23 of a suitable material such as stainless steel. This inner shaft 23 is of generally square cross section, measures approximately five and ½ inches side to side, and is telescopically disposed inside an outer, six inch square, stainless steel shaft 25. A 1/16 inch thick sheet 27 of suitable non-stick material such as that sold by DuPont under the trade designation Teflon is disposed between inner shaft 23 and outer shaft 25 to facilitate the vertical movement of the inner shaft with respect to outer shaft 25. The non-stick sheet is folded over the upper end of outer shaft 25 and held in place by a collar 29. Non-stick sheet 27 not only facilitates the movement of the shafts with respect to each other, but also keeps out dirt from between the shafts and indicates areas of excessive wear. This sheet extends around all four sides of the shafts and extends generally the entire length of the outer shaft along its inner surface. Shafts 23 and 25 are hollow, having a wall thickness of 3/16 inch. Although each is described as stainless steel, other materials and various thicknesses of materials could also be used.

The base of air cylinder 21 is secured in place with respect to outer shaft 25 by a ½ inch diameter threaded fastener 31. As a result, movement of piston 19 results in mounting surface 15 and inner shaft 23 being raised or lowered with respect to the outer shaft. More specifically, a pair of ⅛ inch nylon air lines 33 and 35 are provided to supply air to the air cylinder and to exhaust air from the air cylinder to move the piston upwardly and downwardly as desired. Nylon air lines are stable against swelling over a temperature range of 0° to 650° F. Air cylinder 21 preferably has a travel of three to eight inches, so that seat 13 can be raised and lowered by that amount. Of course, depending upon the size of the boat or vessel a larger lift could be desired.

Figure 5:
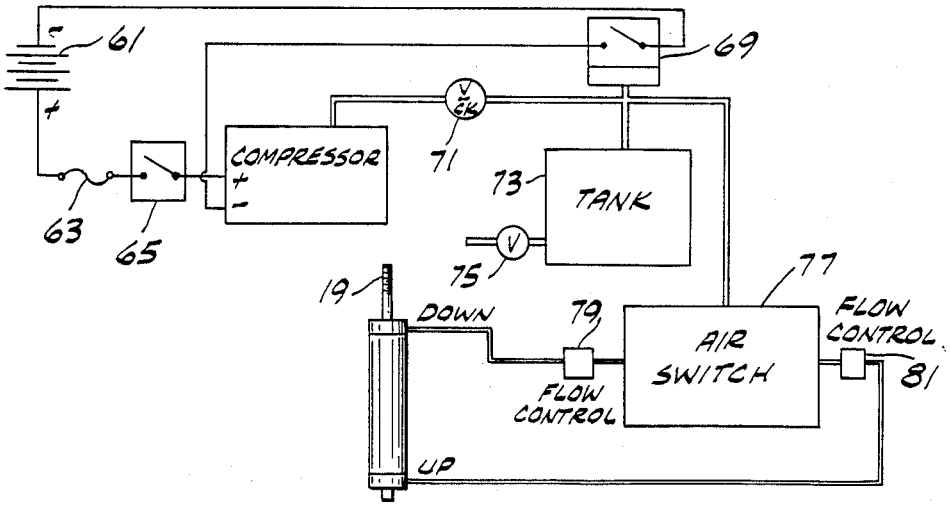
FIG. 5 is a schematic illustrating the pneumatic circuitry of the present invention.

Outer shaft 25 includes a ½ inch opening 37 in its side through which pass nylon air lines 33 and 35 from the cylinder to the control circuitry of FIG. 5. Of course, instead of a two-way air cylinder 21, an air shock having only a single line could be used to provide the pneumatic raising and lowering of seat 13, in which case only a single line would pass through opening 37. Of course, a hydraulic cylinder could be used instead of the air cylinder and the air lines would be replaced by hydraulic fluid.

In addition to securing air cylinder 21 with respect to outer shaft 25, threaded fastener 31 also secures the outer shaft to a square, hollow upstanding flange 39, formed of two inch high steel angle iron. The flange is welded to a stanchion or floor plate 41 which is secured to the deck 43 of the boat. The nut of threaded fastener 31 is preferably welded onto flange 39 to hold it permanently in place. Stanchion plate 41 is preferably an 11 and ½ inch square by ⅜ inch thick plate of stainless steel secured by suitable threaded fasteners 45 to a mounting plate 47 which rests upon deck 43. Threaded fasteners 45 preferably have pointed ends so that if they extend slightly through mounting plate 47 they will suitably engage the surface of deck 43. Mounting plate 47 is of a suitable material such as stainless steel, and is a square generally the same size as stanchion plate 41. The mounting plate has a square central opening 49 of sufficient size to allow an installer to put his hand down through the central opening to mount the mounting plate to deck 43. Specifically, the mounting plate is positioned on the deck 43 in the desired position and an opening 51 of comparable size (five and ½ inches more or less) is cut in the deck's surface. The installer then reaches through openings 49 and 51 and inserts a pair of strips or bars 53 below the deck surface. Mounting plate 47 has ½ inch headless, threaded fasteners 55 welded thereto, which fasteners extend through deck 43 and corresponding openings in mounting strips or bars 53. The bars are approximately twelve inches long, two and ½ inches wide, and ¼ inch thick. The installer then simply reaches through openings 49 and 51 and tightens threaded fasteners 55 to hold the mounting strips or bars in place. Of course, lock washers could be used with threaded fasteners 55. If there is sufficient room under deck 43, it is also possible to insert a power tool through openings 49 and 51 to tighten down threaded fasteners 55. Once the mounting plate and mounting strips are installed, stanchion plate 31 is secured to the mounting plate by threaded fasteners 45. Mounting strips 53 are disposed transversely to the longitudinal axis of seat 13 so that they provide a large surface area resisting the torque exerted on the seat by the acceleration of the boat. In particular, such acceleration causes the rightmost mounting strip 53 as shown in FIG. 1 to be pulled upwardly against deck 43 but this force is spread out over the entire length of the strip. This construction in effect cinches the deck and chair mount together.

In addition to threaded fastener 31, outer shaft 25 is secured to flange 39 by additional threaded fasteners 57 (Fig. 2). This provides a secure mount for shaft 25. As an alternative to opening 37 in the flange for the air lines, a corresponding opening may be cut in stanchion plate 41 for the air lines 33 and 35 instead.

Figure 3:
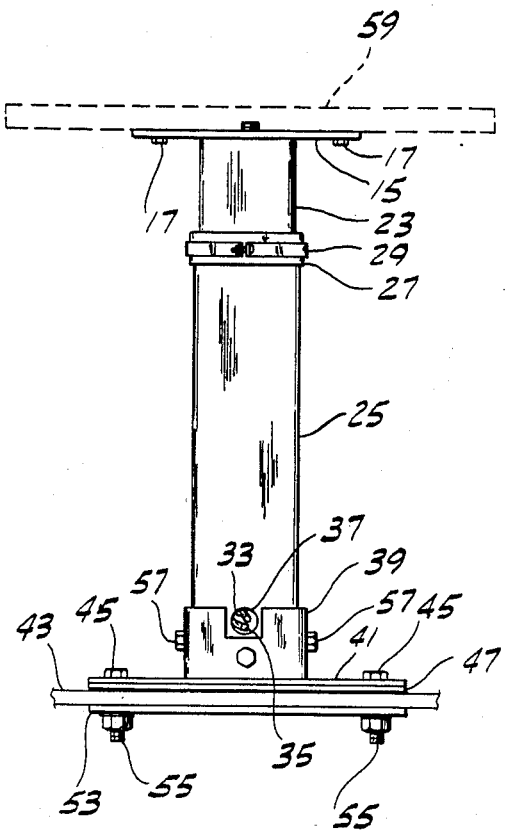
FIG. 3 is a front elevation of an alternative piece of boat furniture of the present invention.

Although the present invention has been described with respect to a seat 13 so far, it is not so limited. In FIG. 3, a table top 59 is shown disposed above and secured to mounting surface 15. With this arrangement, table top 59 can be raised and lowered as desired.

Figure 4:
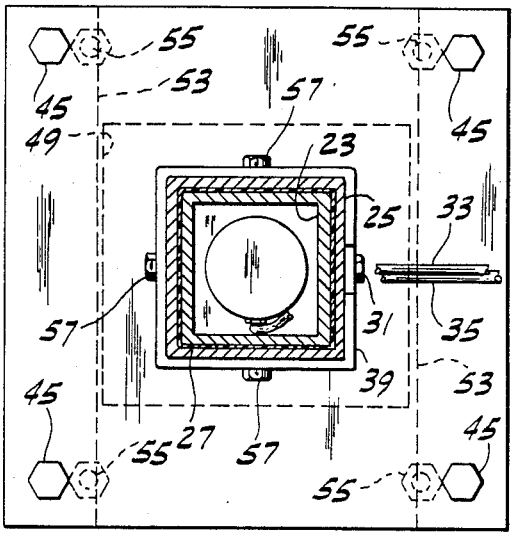
FIG. 4 is a cross sectional view taken along line 4—4 of FIG. 2 with parts broken away for clarity.

As is best illustrated in FIG. 4, inner shaft 23 and outer shaft 25 are tightly telescoped so that any torque on the shaft as would occur by the acceleration of the boat does not result in the twisting or locking of the inner shaft with respect to the outer shaft. The particular arrangement of the square shafts makes it impossible for one shaft to twist substantially with respect to the other during acceleration. This, of course is an important feature when such a seat is used for the operator's seat in a motor boat. Of course, it is precisely during acceleration when the bow of the boat is raised that the operator's seat should be in its highest position. It would be unfortunate indeed if the seat could then twist in one direction or the other at this most critical time. But with the present invention not only is such twisting prevented, but also the operator can raise his seat to such a height as to readily see over the bow, stern and sides of the boat during acceleration. In the event that the operator raises himself above the level of the windshield at this time for better visibility, eye goggles should be worn and seat 11 could be equipped with a seat belt (not shown).

As is also seen in FIG. 4, threaded fasteners 55, which connect the mounting plate to the mounting strips, are off-set from threaded fasteners 45 which connect the stanchion plate 41 to mounting plate 47. Of course, the precise placement of these threaded fasteners could be changed as desired. What is desired is that the mount for chair 11 be as secure as possible.

The schematic illustrating the controlling circuitry for air cylinder 21 is shown in FIG. 5. The pneumatic system includes the twelve volt battery 61 of the boat which is connected through a fuse 63 and a compressor on-off switch 65 to a 100–110 lbs. per square inch compressor 67. Fuse 63 not only protects the compressor but also protects the boat's other electrical components. The compressor is controlled not only by manually actuable switch 65 but also by an air pressure sensitive switch 69 which turns on the compressor at 80 lbs. per square inch and turns off the compressor at 100 lbs. per square inch, for example. A relief check valve 71 set at 110 lbs. per square inch is connected between compressor 67 and a one- to two-gallon air tank 73. The air tank is generally five inches in diameter by fourteen inches in length and includes a safety relief valve 75 set at a 125–150 lbs. per square inch. The size of air tank 73 is such that the chair or table may be raised or lowered two or three times even after the boat's power fails. If desired, tank 73 may be disposed below seat 13 and hidden from view by an optional cover (not shown). The tank is also connected to a manually controllable, solenoid operated air switch 77 having a pair of flow controls 79 and 81 connected between the air switch and air cylinder 21. Preferably on-off switch 65 and air switch 77 are mounted in the dash of the boat for easy access by the operator. When the air switch is activated to lower boat seat 11, air flows through the port marked DOWN to cause piston 19 to be lowered. Similarly, when it is desired to raise the boat seat, the air switch is actuated to cause air to flow from tank 73 through the air switch to the port labeled UP on the air cylinder. Of course, it should be realized that other pneumatic controllers could also be used.

Preferably, brass fittings are used throughout the pneumatic circuitry to provide high reliability.

Figure 6:
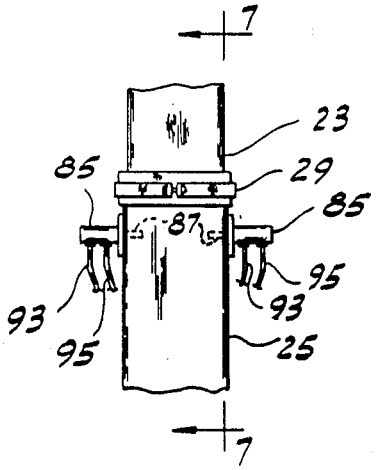
FIG. 6 is a front elevation of one portion of a second embodiment of boat furniture of the present invention.
Figure 7:
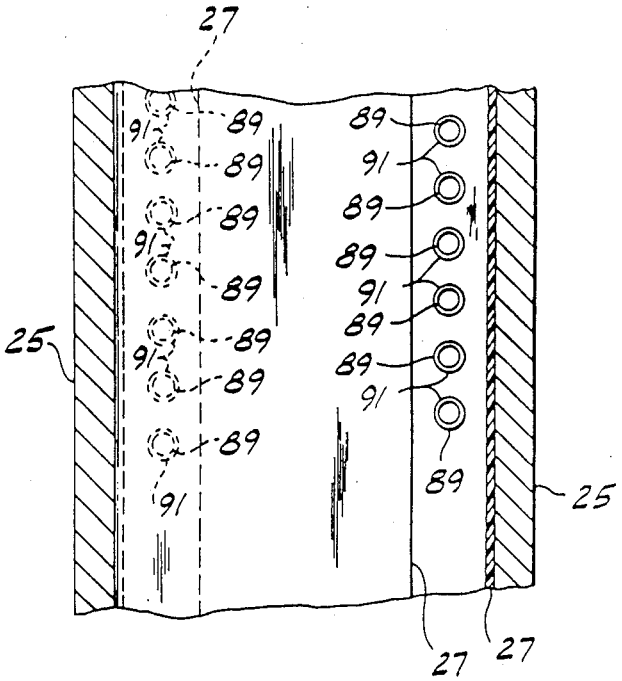
FIG. 7 is a side elevation, on an enlarged scale and with parts broken away for clarity, of the boat furniture of Fig. 6.

In a second embodiment of the present invention (FIG. 6), square outer shaft 25 has secured to opposite sides thereof a pair of dual acting air cylinders 85, each having a piston 87 for selectively locking the shafts in place, as appears below. Alternatively, a single air cylinder 85 could be used or one or more electric push/pull solenoids could be used. The shafts of pistons 87 are preferably of high strengh such as 100,000 psi and have a throw of one-inch. When extended the pistons each pass through a corresponding ½ inch hole in outer shaft 25 and engage one of a plurality of openings 89 (FIG. 7) in inner shaft 23. Openings 89 each include a Teflon or similar grommet 91 to facilitate the insertion of piston 87 in the nearest opening 89 and its removal therefrom. Openings 89 are disposed vertically on one-inch centers with the openings for one piston being offset vertically from the openings for the other piston to ensure that at least one of the pistons engages an opening 89 when it is desired to lock the shafts in place. Alternatively, the openings need not be offset, in which case the operator might need to jog the seat upwardly or downwardly a slight amount to allow the pistons to enter their respective openings. In this embodiment non-stick sheet 27 terminates along a vertical line adjacent the openings so as not to interfere with pistons 87.

Figure 8:
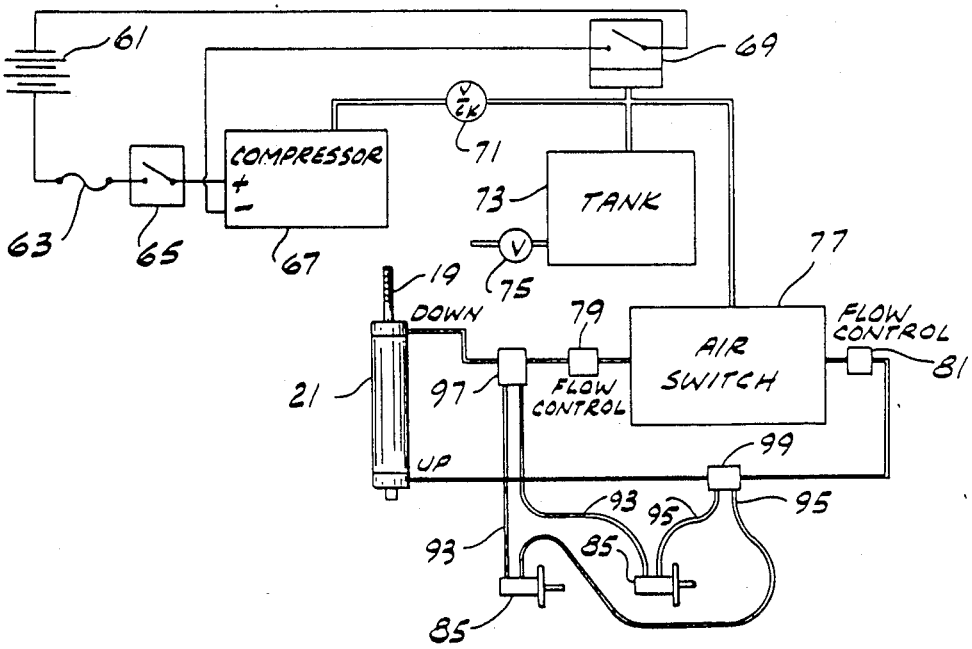
FIG. 8 is a schematic illustrating the pneumatic circuitry for the boat furniture of FIG. 6.

Air cylinders 85 are connected by a pair of air lines 93 and 95 to manually operable air diverter switches 97 and 99 (FIG. 8). Air diverter switch 99 is disposed in the air line from air switch 77 which is connected to the UP port of the shaft-moving air cylinder 21. Once the seat 11 is at the desired height, air diverter switch 99 is actuated to cause air to flow to locking cylinders 85 instead of to shaft-moving cylinder 21. This locks the shafts in place by actuating both pistons 87. Similarly, when the seat is to be moved, air diverter switch 97 is actuated to withdraw both pistons.

Although the air diverter switches 97 and 99 are shown connected downstream from air switch 77, they could instead be connected on the upstream side of air switch 77 so that switch would not have to be actuated to lock and unlock the shafts.

In view of the above, it will be seen that the various objects and features of the present invention are achieved and other advantageous results obtained.

As various changes could be made in the above constructions without departing from the scope of the invention, it is intended that all matter contained in the above description and shown in the accompanying drawings shall be interpreted as illustrative and not in a limiting sense.

What is claimed is:

1. Vertically adjustable boat furniture such as a chair, a table, or the like comprising:

a base securely mountable to the deck of a boat and fixed aginst rotation with respect thereto;

a first hollow shaft of generally square cross section fixedly secured to the base and extending upwardly therefrom, said first shaft being irrotatable with respect to the base;

a second hollow shaft of generally square cross section longitudinally movable with respect to the first shaft, said shafts being coaxial, one of said shafts being disposed at least partially inside the other, the spacing of the shafts being sufficiently small that the shafts cannot rotate with respect to each other;

a fluid operated piston operably secured to the second shaft for moving it longitudinally with respect to the first shaft;

a mounting surface disposed at the top of the second shaft and fixedly secured thereto;

a seat, table top, or the like secured to the mounting surface; and manually controllable means for operating the piston to move the mounting surface to a desired height, whereby the seat, table top, or the like is readily positioned at a desired height with respect to the deck of the boat.

2. The boat furniture as set forth in claim 1 further including a layer of non-stick material disposed between the first and second shafts to facilitate the relative longitudinal movement of the shafts, wherein the layer of nonstick material is folded over the periphery at one end of the outer shaft, further including a collar secured to the outer shaft to hold the folded over portion of the layer in place.

3. The boat furniture as set forth in claim 1 wherein the base including a mounting plate adapted to be secured to the deck, further including a stanchion plate secured by threaded fasteners to the mounting plate, said stanchion platc having an upstanding flange suitable for fixedly mounting to one of the shafts so that said shaft is fixedly secured with respect to the deck.

4. The boat furniture as set forth in claim 3 wherein the piston and outer shaft are each secured to the flange by at least one common treaded fastener.

5. The boat furniture as set forth in claim 1 further including means for locking the outer and inner shafts with respect to each other, wherein the locking means includes a pair of air cylinders securely mounted to opposite sides of one of the shafts, the other of the shafts having two sets of vertically disposed openings to receive the air cylinder pistons.

6. The boat furniture as set forth in claim 5 wherein one set of vertically disposed openings is offset vertically with respect to the other set.

* * * * *

UNITED STATES PATENT AND TRADEMARK OFFICE

CERTIFICATE OF CORRECTION

PATENT NO. : 4,673,155

DATED : June 16, 1987

INVENTOR(S) : William T. Binder

It is certified that error appears in the above-identified patent and that said Letters Patent is hereby corrected as shown below:

Column 2, line 43, delete "ooat" insert --- boat ---

Column 6, line 63, delete "platc" insert --- plate ---

Column 6, line 68, delete "treaded" insert --- threaded ---

Signed and Sealed this

Tenth Day of November, 1987

*Attest:*

DONALD J. QUIGG

*Attesting Officer*

*Commissioner of Patents and Trademarks*